US005927038A

United States Patent [19]

Goldberg et al.

[11] Patent Number: 5,927,038

[45] Date of Patent: Jul. 27, 1999

[54] EXPANDABLE SELF-LOCKING FRAME

[76] Inventors: William S. Goldberg, 821 Tanglewood Trail; Todd G. Jakobsen, P.O. Box 467667, both of Atlanta, Ga.

[21] Appl. No.: 08/878,889

[22] Filed: Jun. 19, 1997

Related U.S. Application Data

[60] Provisional application No. 60/022,249, Jul. 22, 1996.

[51] Int. Cl.[6] ..... E04B 2/58

[52] U.S. Cl. ..... 52/632; 52/238.1; 52/645; 52/656.1; 52/733.2; 403/109.1; 403/377

[58] Field of Search ..... 52/238.1, 243, 52/243.1, 632, 645, 656.1, 656.9, 733.2; 403/109.1, 377

[56] References Cited

U.S. PATENT DOCUMENTS

| | | | |
|---|---|---|---|
| 2,796,158 | 6/1957 | Miles et al. | 52/632 X |
| 3,305,983 | 2/1967 | Bus | 52/243.1 |
| 3,492,766 | 2/1970 | Andrews . | |
| 3,854,264 | 12/1974 | Thomassen | 52/632 |
| 3,897,668 | 8/1975 | McDonnell . | |
| 4,188,147 | 2/1980 | Murphy . | |
| 4,397,127 | 8/1983 | Mieyal . | |
| 4,841,689 | 6/1989 | Schussler . | |
| 5,325,651 | 7/1994 | Meyer et al. . | |
| 5,433,046 | 7/1995 | MacQuarrie et al. . | |
| 5,729,950 | 3/1998 | Hardy | 52/645 X |
| 5,735,100 | 4/1998 | Campbell | 52/645 |
| 5,803,653 | 9/1998 | Zuffetti | 52/645 X |

*Primary Examiner*—Carl D. Friedman
*Assistant Examiner*—Kevin D. Wilkens
*Attorney, Agent, or Firm*—Thomas, Kayden, Horstemeyer & Risley, L.L.P.

[57] ABSTRACT

An expandable self-locking frame useful in the construction of temporary to permanent walls. The frame comprises a plurality of longitudinally extensible studs mounted along the length of a pair of elongated tracks. Each of the longitudinally extensible studs is provided with a longitudinal extension mechanism incorporating a locking mechanism with which a length of the frame can be adjusted. In a preferred embodiment, the outer longitudinally extensible struts of the frame are further provided with lateral extension mechanisms with which the width of the frame can be adjusted.

52 Claims, 4 Drawing Sheets

EXPANDABLE SELF-LOCKING FRAME

REFERENCE TO RELATED APPLICATIONS

This application claims the benefit of U.S. Provisional Application No. 60/022,249, filed Jul. 22, 1996.

FIELD OF THE INVENTION

The present invention generally relates to an expandable self-locking frame. More particularly, the present invention relates to an expandable self-locking frame composed of a plurality of longitudinally extensible struts incorporating longitudinal extension mechanisms, and a pair of elongated tracks which include lateral extension mechanisms. As will be described below, the frame is particularly useful in the construction of temporary, semi-permanent, and permanent interior walls. However, several alternative applications for the frame will be disclosed.

BACKGROUND OF THE INVENTION

Various framing systems have been devised to reduce the cost and simplify the installation of certain structures. In the case of wall framing systems, the prior art discloses an upper channeled track and a lower channeled track which are secured to a ceiling and a floor respectively. Bridging the distance between the two tracks is a plurality of vertically extensible studs which may be adjusted in length to accommodate the dimensions of a room in which the frame will be installed. In such systems, the vertically extensible studs are most often composed of a thin gauge metal and, like the upper and lower channeled tracks, are provided with an elongated channel therein. Mounted within the elongated channels of the extensible studs are vertical extension mechanisms which typically provide for telescopic extension of a vertical extension member of the stud. Once the vertically extensible studs are fully extended such that the upper and lower ends of the studs are in contact with the upper and lower tracks respectively, they are attached to the upper track and decorative wall covering such as drywall panels or wood panels can be affixed to the wall frame.

Although the majority of known wall framing systems are generally configured as discussed above, various locking means have been developed for maintaining the extension members in the desired extended position. U.S. Pat. No. 3,492,766 discloses one such system in which the extension members are each provided with cutout tabs which may be manually bent back into contact with slots provided in the studs such that the extension members are prevented from being retracted into the studs. Although simple in design, these cutout tab systems have several drawbacks. Firstly, since locking is only accomplished with manual bending back of the cutout tabs, these systems are labor intensive and do not have the advantage of being self-locking. Furthermore, due to the difficulty in bending back the cutout tab while simultaneously maintaining the extension member in the fully extended position, the extension member is likely to retract slightly into the stud during the locking procedure. Moreover, in that the thin gauge cutout tab is the only mechanism preventing retraction of the extension member, these systems do not appear capable of functioning as load bearing structures.

In another known system disclosed in U.S. Pat. No. 3,897,668, the extension members are spring-loaded so as to be self-adjusting to the height of the ceiling. Although this feature simplifies the installation process, such a system, like the cutout tab systems, do not appear to be usable in load bearing applications. Accordingly, the wall frame cannot be pressure fit in place to ensure wall rigidity.

In U.S. Pat. No. 5,433,046, a plurality of bearings and brackets are used to provide for the extension and locking of an extension portion of a frame. The complexity of this system and the associated expense of its fabrication, however, present a significant drawback to the typical unskilled installer.

It is to be noted that none of the above described systems disclose a lateral extension mechanism with which the width of the frame may be adjusted.

Accordingly, it can be seen that it would be desirable to provide an adjustable frame system which is both easy to install and inexpensive to produce. Moreover, it would be desirable to provide such a frame which further is self-locking and may be used in load bearing situations. Further, it would be desirable to provide such a frame which also includes lateral extension mechanisms with which the width of the frame can be adjusted.

SUMMARY OF THE INVENTION

Briefly stated, the present invention comprises an expandable self-locking frame. Where the frame is to be used as a wall frame, the invention more particularly comprises an upper and a lower elongated track which are adapted to engage a floor and a ceiling, respectively. Extending between the tracks is a plurality of horizontally spaced vertically extensible studs which each include an elongated stud member, and in some instances, a vertical extension mechanism, and a vertical locking mechanism. Each elongated stud member is provided with a vertically extending channel and is arranged such that its lower end connects to the lower elongated track.

The vertical extension mechanism includes a vertical extension block, a stationary block, and an elongated connector rod. The vertical extension block is slidably disposed in the vertically extending channel adjacent the upper end of the elongated stud member. Typically, the vertical extension block is provided with a clamping bracket which slidably engages the elongated stud member to retain the extension block in position within the vertically extending channel. The stationary block is fixedly disposed in the vertically extending channel at a predetermined position along the channel between the upper and lower ends of the elongated stud member. The elongated connector rod typically takes the form of a threaded push rod which extends through the stationary block and fixedly attaches at an upper end to the vertical extension block and at a second end to a vertical adjustment block. The vertical adjustment block may be used to force the rod toward the end of the elongated stud member to extend the vertical extension block beyond the upper end of the elongated stud member. Typically, the vertical extension block, stationary block, and the vertical adjustment block each is dimensioned to fit in a substantially flush manner within the vertically extending channel of the elongated stud member. Each block is provided with guide slots that are adapted to engage inwardly extending flanged edges provided in the elongated stud member along the vertically extending channel. To assure that correct orientation of the frame is achieved during installation, one or more of the extensible studs at least one can be provided with an integral level device which indicates whether the particular vertically extensible stud in which the stationary block is mounted is oriented in a level manner.

The vertical locking mechanism is mounted to the stationary block and engages the threaded push rod. Typically, the locking mechanism includes a detent lever having an aperture through which the threaded push rod extends. The detent lever is biased against the threaded push rod with a spring which is disposed about the rod between the stationary block and the detent lever. In use, the threaded push rod may be forced through the detent lever aperture in an upward direction with the vertical adjustment block. As the push rod is forced through the aperture, the detent lever is successively momentarily displaced by the threads of the rod in a ratcheting manner. Due to the bias provided by the spring, the detent lever opposes travel of the push rod in a downward or retraction direction, thereby locking the extension block in the desired extension position. Arranged in this manner, the threaded push rod, and therefore the vertical extension block, may only be retracted downwardly if the detent lever is first released by depressing a distal end of the lever toward the stationary block against the force of the spring. Once so depressed, the threaded push rod and extension block may be manually retracted.

As described, the wall frame can be vertically expanded toward a ceiling until the wall frame is firmly wedged between the floor and ceiling, therefore accomplishing a pressure fit. Due to ratcheting function of the locking mechanism, the frame automatically locks in the desired extended position. Therefore, the frame may be said to be "self-locking."

To further reinforce the frame and accomplish pressure fitting, the locking mechanism may further include a locking nut disposed on the threaded push rod adjacent the stationary block. This locking nut may be firmly threaded against a surface of the stationary block to ensure that the vertical extension block will not inadvertently retract into the elongated stud member when a load is applied and also can be used to further extend the vertical extension block to attain a pressure fit.

In order to permit adjustment of the width of the frame, one or more sides of the frame can be provided with horizontal extension mechanisms. Typically, an upper horizontal extension block attaches to an upper end of the vertical extension blocks of outer studs of the frame, with the horizontal extension blocks extending laterally therefrom. A portion of the upper horizontal extension block is slidably disposed in a horizontally extending channel provided in the upper elongated track. The lower horizontal extension block attaches at the lower end of the elongated stud member and is likewise slidably disposed in a horizontally extending channel provided in the lower elongated track. Typically, both the upper and lower lateral extension blocks are provided with outwardly biased retainers such as spring loaded plungers. When so provided, both the upper and lower elongated tracks are provided with horizontally spaced detents adapted to receive the outwardly biased retainers so that the horizontal extension blocks can be releasably retained in predetermined lateral positions corresponding to the individual detents. As with the vertical extension mechanism blocks, it is preferred that each of the horizontal extension blocks is provided with guide slots adapted to engage inwardly flanged edges provided in the elongated tracks.

Arranged in this manner, the width of the wall frame can be adjusted by altering the lateral position of the extension blocks which, in turn, alters the lateral position of the associated extensible studs.

Thus, it is an object of this invention to provide an expandable frame which can be expanded vertically with self-locking extensible studs.

Another object of this invention is to provide an expandable frame which may be expanded horizontally with horizontal extension mechanisms.

A further object of this invention is to provide an expandable frame of simple construction that can used in load bearing or pressure fit situations.

Yet another object of this invention is to provide an expandable frame which is both easy to install and inexpensive to manufacture.

Other objects, features and advantages of the present invention, will become apparent upon reading the following detailed description, when taken in conjunction with the accompanying drawings.

DESCRIPTION OF THE PREFERRED EMBODIMENTS

Figure 1:
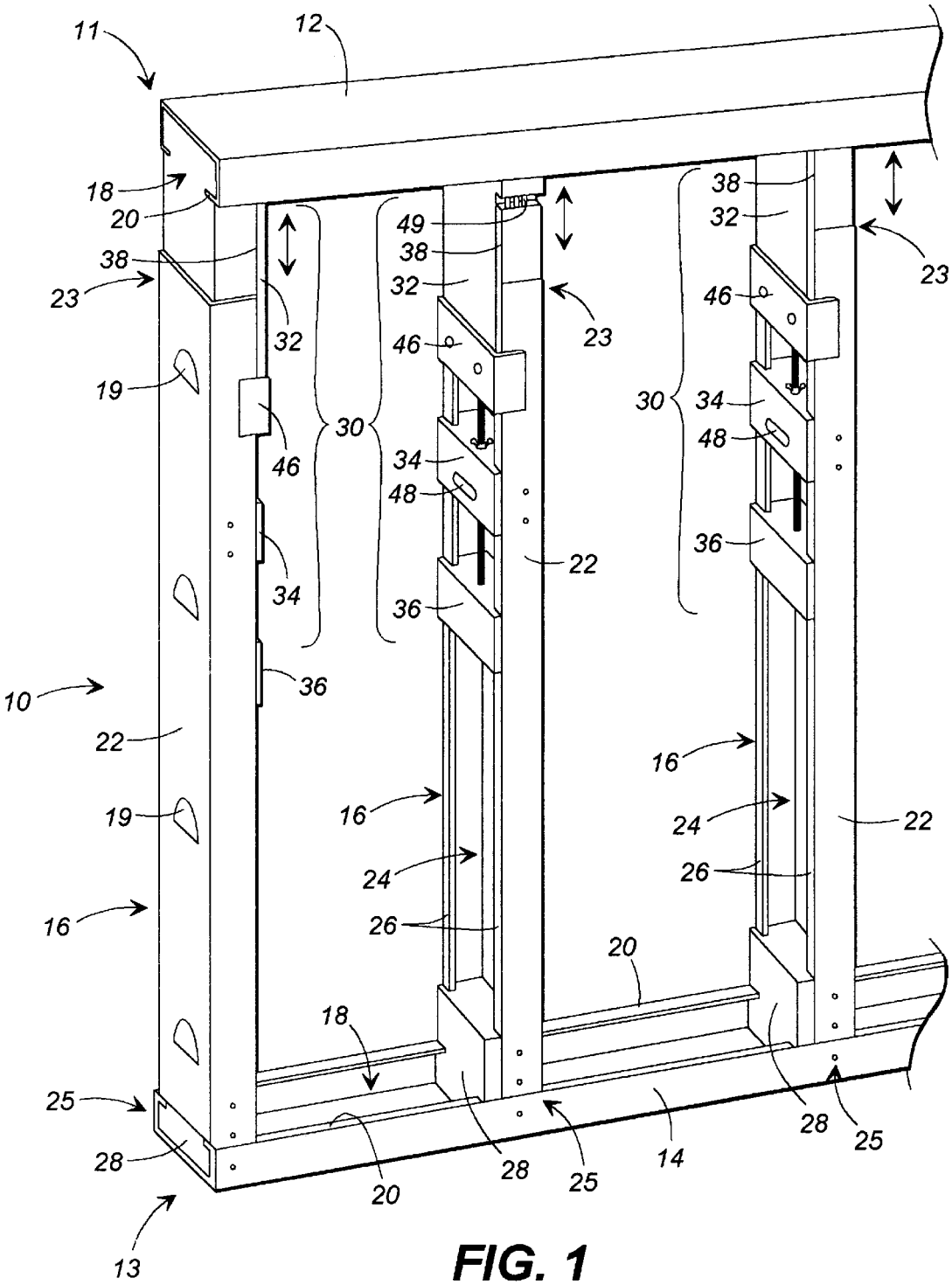
FIG. 1 illustrates an elevated perspective view of a first expandable self-locking frame of the present invention.

Although specific forms of the invention have been selected for illustration in the drawings, and the following description is drawn in specific terms for the purpose of describing these forms of the invention, this description is not intended to limit the scope of the invention which is defined in the appended claims.

Figure 4:
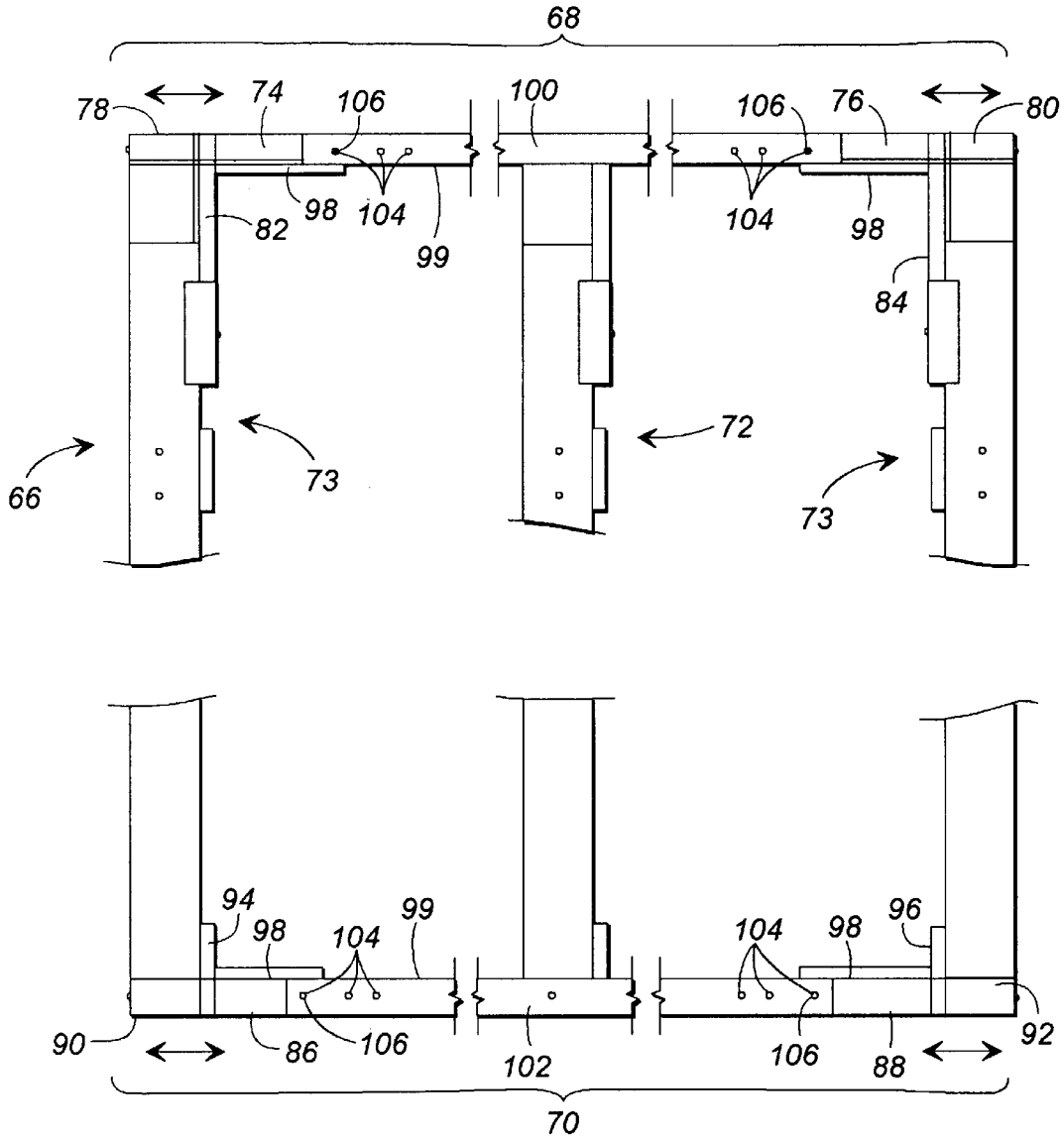
FIG. 4 illustrates a partial front elevational view of a second expandable self-locking frame including horizontal extension mechanisms.
Figure 5:
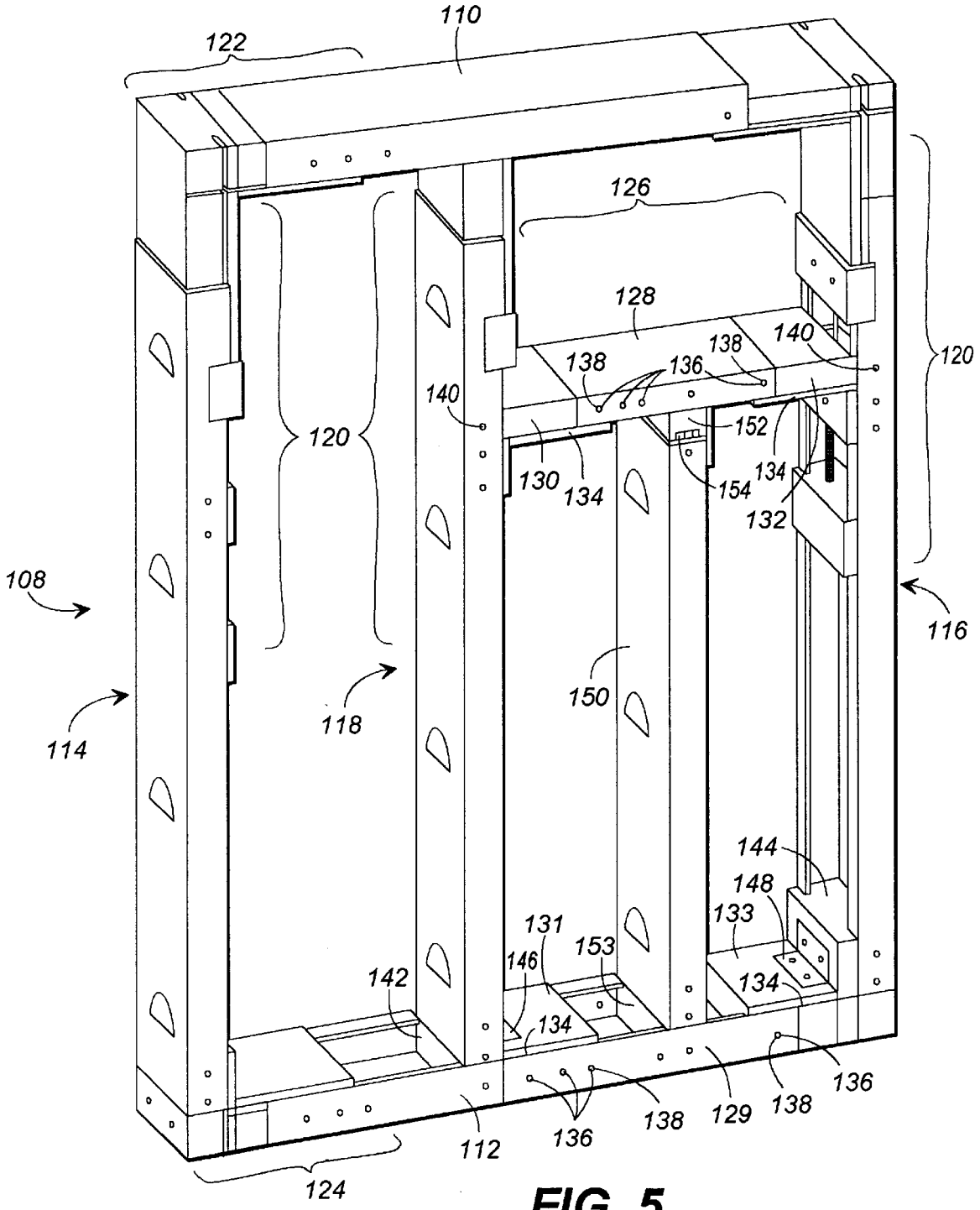
FIG. 5 illustrates an elevated perspective view of a third expandable self-locking frame including a door frame mounting section.

For purposes of description, the terms "upper", "lower", "vertical", "lateral", and derivatives thereof shall relate to the invention as oriented in FIGS. 1, 4, and 5.

Referring now in greater detail to the drawings in which like numerals indicate like parts throughout the several views, FIG. 1 illustrates a first expandable self-locking frame 10 having a first or upper end 11 and a second or lower end 13. Although the frame will be described primarily in terms of the construction of interior walls, it is to be understood that application is exemplary only. As shown in the figure, the expandable self-locking frame 10 can be formed as a wall frame comprising an upper elongated track 12, a lower elongated track 14, and a plurality of horizontally spaced vertically extensible studs 16 which connect the elongated tracks. In applications other than wall construction, these components may more generally be designated as a first elongated track, a second elongated track, and a longitudinally extensible strut, respectively.

As depicted in FIG. 1, both the upper elongated track 12 and the lower elongated track 14 are substantially U-shaped. Forming this U-shape are horizontally extending channels 18 which are provided in each track. Along the extent of these channels 18 are inwardly extending flanged edges 20 which will be discussed in more detail below. When configured in an orientation other than that shown in FIG. 1, these horizontally extending channels may be more generally designated as longitudinally extending channels.

The vertically extensible stud 16 is primarily composed of an elongated strut or stud member 22. As is apparent in FIGS. 1 and 2, each elongated stud member 22 has a first or upper end 23 positioned adjacent the upper elongated track 12, and a second or lower end 25 connected to the lower elongated track 14. Similar to the elongated tracks, each elongated stud member 22 is also substantially U-shaped and is provided with a vertically extending channel 24. As with the horizontally extending channels, the vertically extending channels may more generally be described as longitudinally extending channels. These channels 24 are provided with inwardly extending flanged edges 26. In one arrangement, each of the elongated tracks and the vertically extensible studs is formed from a thin gauge metal and is provided with a plurality of spaced utility cutouts 19, such as is typically used in commercial construction. However, other materials which could provide lightweight rigidity, such as wood or plastics, could be alternatively used.

Connected at the lower end 25 of each elongated stud member 22 is a track mounting member 28. Although formable in alternate configurations, this mounting member typically takes the form of a block which is dimensioned to fit in a substantially flush manner within both the vertically extending channel 24 of the elongated stud member 22 and the vertically extending channel 18 of the lower elongated track member 14 such that the stud member is connected to the elongated track. As depicted in the figure, the track mounting block 28 may be affixed to both the stud member 22 and the lower elongated track 14 with a fastener such as a screw, bolt, or rivet. It will be understood, however, that any effective means of fixation could be alternatively employed, such as bonding, welding, and the like.

Figure 2:
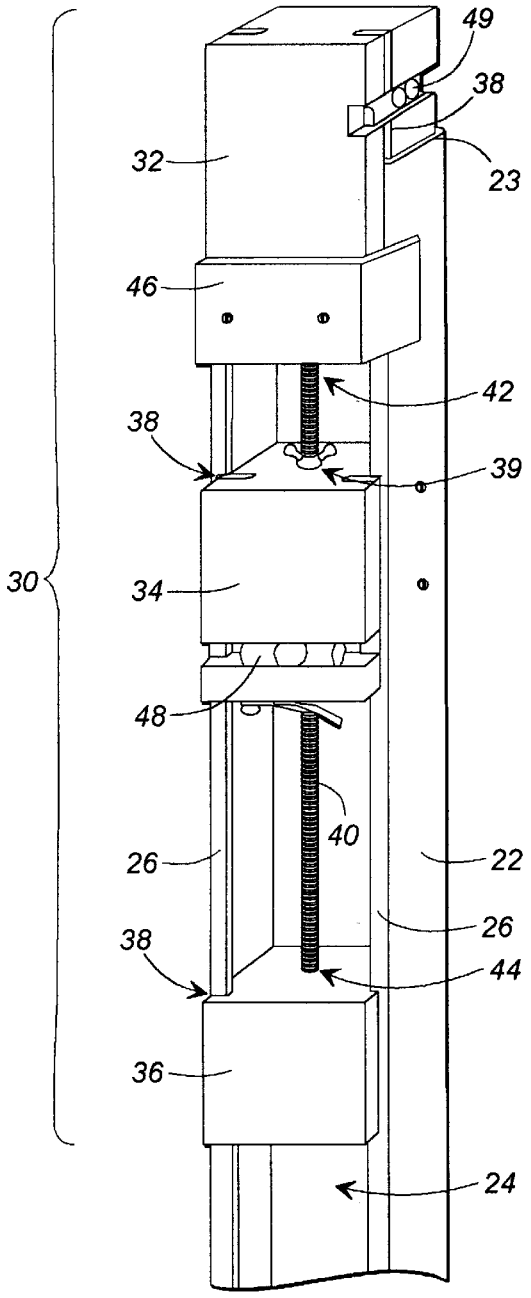
FIG. 2 illustrates an elevated partial perspective view of a vertically extensible stud of the expandable self-locking frame shown in FIG. 1.

As illustrated most clearly in FIGS. 1 and 2, the elongated stud member 22 also comprises a vertical extension mechanism 30 which, more generally, functions as a longitudinal extension mechanism. The vertical extension mechanism 30, generally comprises a vertical extension block 32, a stationary block 34, and a vertical adjustment block 36. Each of these blocks is disposed within the vertical extending channel with the vertical extension member 32 situated adjacent the upper end 23 of the elongated stud member, the vertical adjustment block 36 positioned adjacent a middle portion of the elongated stud member, and the stationary block 34 positioned between the vertical extension block 32 and the vertical adjustment block 36. It is to be noted that, where the frame is not used for wall construction, the mechanism may be described as comprising a longitudinal extension block and a longitudinal adjustment block.

As shown in FIGS. 1 and 2, each of the extension block 32, stationary block 34, and adjustment block 36, typically is dimensioned to fit within the vertically extending channel 24 of the elongated stud member 22 in a substantially flush manner. Although the blocks are depicted as being formed from wood, alternative materials such as metal, plastics, and the like would work equally well. Moreover, it is to be noted that, although block members are described herein and depicted in the drawings, the extension block, stationary block, and the adjustment block could alternatively be formed other than in block form. In such a case, these components could be generally termed a longitudinal extension member, a stationary member, and a longitudinal adjustment member. As an example, these members could be formed as bracket members composed of a thin gauge metal similar to that used for the fabrication of the elongated stud members and the elongated tracks. In such a configuration, the bracket members would be dimensioned to fit in a substantially flush manner with the channels of the stud member and would be operable in substantially the same manner as described above.

When a block construction is utilized, each of the blocks is provided with guide slots 38 which are configured to accept the inwardly extending flanged edges 26 of the elongated stud member 22. Arranged in this manner, the vertical extension block 32 and the vertical adjustment block 36 may be slid along the vertically extending channel 24 as indicated by the arrows shown in FIG. 1. Unlike the extension block 32 and the adjustment block 36, the stationary block 34 is fixed in place at a predetermined position between the other two blocks of the extension mechanism 30. Although fixation may be accomplished by any known method, typically the stationary block 34 is secured with fasteners such as screws, bolts, or rivets which extend through a side wall of the elongated stud member 22.

Extending through an aperture 39 provided in the stationary block 34 is an elongated connector member 40. The elongated connector member 40 typically is configured as a threaded push rod having a first or upper end 42 which fixedly connects to the vertical extension block 32 and a second or lower end 44 which fixedly connects to the vertical adjustment block 36. Arranged as such, the vertical extension block 32 and the vertical adjustment block 36 are directly connected so that vertical displacement of the adjustment block 36 will effect similar vertical displacement of the extension block 32.

It is preferred that the vertical extension block 32 is provided with a clamping bracket 46 which is mounted thereto. As shown in FIGS. 1 and 2, the clamping bracket 46 clamps about the sides of the elongated stud member 22, in frictional engagement therewith, to prevent the vertical extension block from leaving the channel of inadvertently the elongated stud member in response to any expansion of the elongated stud member that occurs in response to the application of heavy loads on the extensible stud. Typically, the clamping bracket 46 is attached to the extension block 32 with screw, bolt, or rivet fasteners, although any known attachment means may be used.

To permit the user to more readily install the expandable self-locking frame 10, one or more of the vertically extensible studs 16 can be provided with means for determining whether the stud is level. Typically, these means take the form of integral level devices 48 and 49 which are mounted within the stationary block 34 and the extension block 32 respectively as shown most clearly in FIGS. 2 and 3. As depicted in these figures, these level devices can be "bubble" levels of conventional design. By providing two such level devices in separate planes, the user can ensure that the frame is level in both planes before the frame is locked in place.

Figure 3:
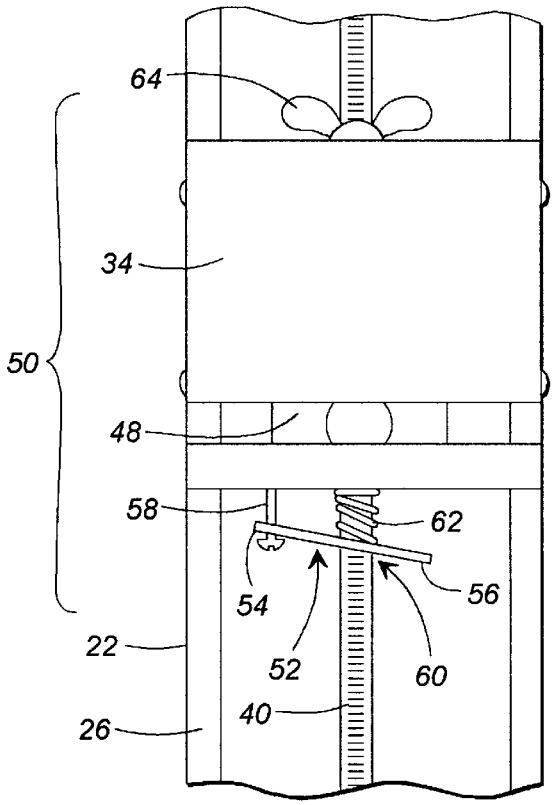
FIG. 3 illustrates a front elevational view of the vertical extension mechanism of the vertically extensible stud.

As illustrated in FIGS. 1–3, each vertically extensible stud 16 is provided with a locking mechanism 50 which is connected to the stationary block 34. This locking mechanism generally comprises a detent lever 52 having a proximal end 54 and a distal end 56. Connecting the proximal end 54 of the detent lever 52 to the stationary block 34 is a fastener 58. Typically, this fastener is a screw or bolt, however, any appropriate fastener could be substituted. An aperture 60 is provided through the detent lever 52 between the proximal and distal ends. As shown in FIG. 3, the threaded push rod 40 extends through this aperture 60. Disposed about the threaded push rod 40 between the stationary block 34 and the detent lever 52 is a spring 62 which biases the detent lever against the threaded push rod.

Configured in this manner, the threaded push rod 40 may be forced upwardly in an extension direction toward the upper end 23 of the elongated stud member 22 with the threads of the threaded push rod 40 successively momentarily displacing the detent lever 52 to achieve a ratcheting effect. Since the detent lever is biased such that it is oriented in a plane oblique to the threaded push rod as shown in FIG. 3, the detent lever opposes travel of the threaded push rod in a downward or retraction direction, i.e., toward the lower end 25 of the elongated stud member 22. Accordingly, when used for wall construction, the vertically extensible stud 16 will be automatically locked in a vertically extended position without significant inadvertent downward movement of the extension member occurring. To effect retraction of the vertical extension block, the detent lever 52 must first be released by depressing the distal end 56 against the force of the spring 62 and toward the stationary block 34. Once so depressed, the threaded push rod 40 may be pulled toward the lower end 25 of the elongated stud member 22, thereby retracting the extension member 32 into the stud member. It is to be understood that, although the elongated connector member has been described as taking the form of a threaded push rod, the elongated connector member can take the form of any elongate member which could be retained by the detent lever.

The locking mechanism 50 further may be provided with an additional locking means to ensure positive locking and to provide for pressure fitting of the frame 10. As illustrated in FIGS. 2 and 3, this additional locking means typically is a locking nut 64. This locking nut is depicted in the locked position, being firmly threaded on the threaded push rod 40 against the stationary block 34. As can be appreciated from FIG. 2, the locking nut 64 prevents the threaded push rod 40, and therefore the vertical extension block 32, from traveling in the downward or retraction direction. Furthermore, the locking nut 64 can be used to recapture any amount of extension lost from inadvertent retraction of the extension block 32, should any such retraction occur. Moreover, once the frame is positioned as desired, the locking nut 64 can be used to pressure fit the frame between the floor and ceiling by further threading the nut in the tightening direction to further extend the extension block. It is to be noted that, although shown as a wing nut, a standard hexagonal nut, or any other device capable of providing continuous incremental adjustment of the push rod, could be used.

So described, the expandable self-locking frame 10 and its constituent elements shown in FIGS. 1–3 may be easily implemented by the user to serve various functions. Where the frame 10 is to be used as an interior wall frame, an appropriately dimensioned frame is first selected. Typically, the wall frame 10 will be dimensioned to accommodate standard interior rooms having ceilings that are approximately eight feet in height. Accordingly, in most embodiments of the invention, the wall frame will have a minimum height of approximately seven feet and will be extensible to approximately nine feet. This range could, of course, be altered to accommodate rooms with lower or higher ceilings.

Although the wall frame could be fabricated in various different widths for construction of partitions or walls of various extents, it is anticipated that the wall frames will be available in standardized sections approximately between two and a half to four feet in width. Each of these sections can be attached together with fasteners such as plastic snap fit fasteners to aid in forming a flush, continuous wall. The fasteners are adapted to extend through pre-formed openings (not shown) in the outer studs of each wall frame. It is anticipated that these openings of at least one end of each frame will be formed as elongated slots such that the wall frames may be attached even when supported by uneven or distinct floor surfaces.

In addition to the wall frame sections described above, it is further anticipated that relatively narrow extension wall frames including only two or three vertically extensible studs be made available to the user for situations in which utilization of only the standard wall frames described above would result in a longer than desired wall. Accordingly, the user may select any number of wall frames to form a partition or wall of unlimited extent.

Once the correct frame or frames have been selected, the frames are simply positioned in the desired position on the floor surface and each vertically extensible strut 16 is extended upwardly by sliding the vertical adjustment block 36 toward the upper end 23 of the elongated stud member 22 until the upper elongated track 12 is forced into contact with the ceiling. Before fully extending the frame, the user may view the integral level devices 48 and 49 mounted in at least one of studs 16 to ensure that the wall frame is oriented in a level manner in two planes. Leveling can then be achieved by effecting minor adjustments of the vertical orientation of each stud until the level devices indicate that the studs are properly leveled. At this point, the adjustment block 36 of each stud 16 may be firmly urged upwardly until the wall frame is securely wedged between the floor and the ceiling. Finally, the locking nuts 64 can be firmly threaded against the stationary blocks 34 to pressure fit the frame in place.

After the wall frame is securely positioned in the room, decorative wall panels such as drywall, gypsum board, wood paneling, and the like may be attached to the wall frame in the manner conventional in home building to complete the construction of the wall. Installed as described above, the user can form a temporary or semi-permanent wall which is nearly as sturdy as any pre-existing wall of the home. If desired, the wall can be permanently affixed in place by attaching it to the home with screws or nails in the conventional manner. As can be appreciated from this description, this wall can be constructed without the need tools or of special expertise. Accordingly, the frame is well suited for both the professional contractor and the layperson.

Where the wall is to be temporary, it is advisable to place some form of padding or cushioning between the upper elongated track 12 and the ceiling and/or between the lower elongated track 14 and the floor so that the finish of these surfaces is not marred and to further prevent slippage of the frame. Although not illustrated, this padding can take the form of rubber or elastomeric coatings and the like which are applied to the tracks during fabrication of the frame units.

Since each stud of the frame is independently extensible, the wall frame can be used in applications in which the floor and the ceiling are not completely parallel with one another. In such situations, each stud can be extended to maintain its associated portion of the upper elongated track in contact with the ceiling. Although depicted in the figures as having unitary one-piece elongated tracks, it is to be understood that the wall frame could alternatively be provided with elongated tracks formed of a plurality of pivotally connected track segments which join adjacent vertically extensible struts. Such a configuration would permit the wall frame to adapt to rooms in which the floor, ceiling, or both are uneven, with the elongated tracks following the contours of each uneven surface.

As mentioned above, the expandable self-locking frame described herein is capable of several alternative uses. Generally speaking, the frame could be used in any situation calling for an expandable structure. More particularly, the basic concepts of the frame could be implemented in exterior wall construction, roof truss construction, light duty bridge construction, and the like. For example, the frame of the present invention is well suited for greenhouse construction. In such an application, translucent panels made of glass or plexiglass are mounted to the frames instead of standard interior wall panels. Once the walls have been formed, a pitched roof can be formed with other expandable frames likewise provided with translucent panels. To support the roof frames on top of the frames forming the walls of the greenhouse, angled trusses may be formed by using two frame units for the end walls of the greenhouse and orienting the upper elongated tracks of these frames at an angle with respect to their respective lower elongated tracks such that an angled truss is formed. When finally assembled together, the net result is a functional greenhouse having the particular dimensions desired by the builder.

As illustrated in FIG. 4, an alternate embodiment of the expandable self-locking frame 66 can include first or upper and second or lower horizontal extension mechanisms 68 and 70. In this embodiment, the expandable self-locking frame 66 comprises a plurality of vertically extensible studs 72 similar to those described above in reference to the embodiment shown in FIG. 1. However, in this second embodiment, outer vertically extensible studs 73 are provided with first or upper horizontal extension blocks 74 and 76 which are mounted to distal or upper ends 78 and 80 of vertical extension blocks 82 and 84 respectively. These studs are further provided with second or lower horizontal extension blocks 86 and 88 which are mounted to distal or lower ends 90 and 92 of track mounting blocks 94 and 96 respectively. Each of these horizontal extension blocks is mounted to the stud in a manner which allows the blocks and the studs to pivot slightly with respect to each other to permit more flexibility in installing the frame. Similar to the blocks of the vertical extension mechanism, each of the horizontal extension blocks 74, 76, 86, and 88, typically is dimensioned to fit in a substantially flush manner within horizontally extending channels provided in both the upper elongated track 100 and the lower elongated track 102. Furthermore, each of the blocks includes guide slots 98 which are adapted to engage inwardly extending flanged edges 99 of the upper and lower elongated tracks 100 and 102. As with the blocks of the vertical extension mechanism, it is to be appreciated that these extension blocks could be formed other than in block form. In such situations, the horizontal extension blocks may be more generally referred to as lateral extension members. By example, these members could comprise bracket members composed of a thin gauge metal. Further, where both the vertical extension members and the horizontal extension members are formed as bracket members, the vertical and horizontal extension members may be formed as a one-piece unitary L bracket.

As further indicated in FIG. 4, each elongated track is provided with a plurality of horizontally spaced detents 104 which are adapted to engage outwardly biased retainers 106 provided in the horizontal extension blocks 74, 76, 86, and 88. Typically, each of these outwardly biased retainers 106 will comprise spring-loaded plungers having a diameter slightly larger than the diameter of the detents 104. As such, the horizontal extension blocks can be releasably retained in various lateral positions corresponding to the particular detent engaged by the outwardly biased retainer or otherwise placed in any other desired lateral position. The outer vertically extensible studs 73 may therefore be laterally adjusted as indicated by the arrows shown in FIG. 4. Configured in this manner, the expandable self-locking frame can be both vertically and horizontally expanded to suit the needs of the particular builder.

FIG. 5 shows a door frame mounting embodiment 108 of the expandable self-locking frame 108. Although this embodiment is described in terms of door frame mounting, it will be understood that other structures such as window frames and the like could also be integrated into the frame mounting embodiment in similar fashion. Like the previously described frame embodiments, the door frame mounting embodiment 108 comprises upper and lower elongated tracks 110 and 112, and first and second outer vertically extensible studs 114 and 116. Provided in between the outer vertically extensible studs is a central vertically extensible stud 118. Each of the studs 114, 116, and 118, is provided with a vertical extension mechanism 120 similar to that described above in reference to other embodiments. Moreover, the first outer vertically extensible stud 114 is provided with upper and lower horizontal extension mechanisms 122 and 124 of the type described in reference to the embodiment of FIG. 4.

The frame 108 is further provided with a door frame mounting section 126 which comprises an upper intermediate track portion 128 and a lower intermediate track portion 129 that extend horizontally between vertically extensible studs 116 and 118. Extending from the studs 116 and 118 are horizontal extension blocks 130, 131, 132, and 133. Each of these horizontal extension blocks is provided with guide slots 134 which are adapted to engage inwardly flanged edges of the intermediate track portions. Like the upper and lower elongated tracks 110 and 112, the intermediate track portions 128 and 129 are provided with a plurality of horizontally spaced detents 136 which are adapted to engage outwardly biased retainers 138 provided on each of the horizontal extension blocks 130–133. Arranged in this manner, a rectangular door frame mounting section 126 is outlined by the extensible studs 116 and 118, the intermediate track portions 128 and 129, and their associated horizontal extension blocks 130–133.

As indicated in FIG. 5, horizontal extension blocks 130 and 132 typically attach to the vertically extensible studs 116 and 118 with screw, bolt, or rivet fasteners 140 which extend through the studs. In contrast, the horizontal extension blocks 131 and 133 associated with intermediate track portion 129 attach to track mounting blocks 142 and 144 which are attached to the studs 116 and 118 with angled mounting brackets 146 and 148.

Also included in the door frame mounting section 126 is an intermediate stud member 150. As shown in FIG. 5, this intermediate stud member 150 extends from the upper intermediate track portion 128 to the lower intermediate track portion 129. Connecting the intermediate stud member 150 to these track portions are upper and lower track mounting blocks 152 and 153. As indicated, these mounting blocks 152 and 153 attach to the intermediate track portions and to the intermediate stud member with fasteners such as screws, bolts, rivets, or the like. Provided in the upper track mounting block 152 is an integral level device 154 which is similar in form and function to those described above.

In accordance with this arrangement, the frame 108 can be installed between a floor and ceiling in the typical manner. Before fully extending the frame to secure it in place, vertically extensible stud 118 may be horizontally moved from side to side to accommodate installation of pre-hung door frames of various sizes. Each of the longitudinally spaced detents 136 are arranged such they correlate to various standard door frames. It is anticipated that the intermediate tracks 128 and 129 will be provided with indicia indicating the door width associated with each detent. To select a particular door width, the user simply arranges the horizontal extension blocks 130 and 131 such that the outwardly biased retainers 138 mounted therein engage the appropriate labeled detent correlating to the particular door to be installed. In addition, the tracks may also be provided with measurement indicia such as an imprinted ruler or the like to further aid in the installation process.

Once the door frame mounting section 126 has been adjusted to the proper width, the user then checks each integral level device to ensure the frame is plumb and level. After being adjusted into a plumb and level orientation, the frame 108 may be fully pressure fitted in place. Next, a door frame mounting space is created by first removing the fasteners provided in the upper track mounting member 152 and the angled mounting brackets 146 and 148. Once these fasteners are removed, an inverted T-section composed of the intermediate stud member 150, lower intermediate track portion 129, and the lower horizontal extension blocks 131 and 133, is removed from the frame. After being removed, the pre-hung door may be installed in place in the manner typically employed in home building. It is to be noted that frame mounting blocks, similar in form to the stationary blocks, could be provided in various positions along the vertically extending channels of the studs 116 and 118 to facilitate such installation.

In light of the above, it will be appreciated that the present invention provides an expandable self-locking frame with great advantages over the prior art. While the forgoing invention has been described in the form of preferred embodiments, it will be understood by those skilled in the art that numerous modifications, variations, and changes, can be made thereto without departure from the spirit and scope of the invention as set forth in the following claims.

We claim:

1. An expandable self-locking frame comprising:

a first elongated track and a second elongated track; and at least one longitudinally extensible strut, said longitudinally extensible strut having an elongated strut member, a longitudinal extension mechanism, and a locking mechanism;

said elongated strut member having a longitudinally extending channel provided therein and further having a first end and a second end, said second end of said strut member connected to said second elongated track;

said longitudinal extension mechanism including a longitudinal extension member slidably disposed in said longitudinally extending channel adjacent said first end of said elongated strut member and contacting said first elongated track, a stationary member fixedly disposed in said longitudinally extending channel between said first end and said second end of said elongated strut member, and an elongated connector member extending through said stationary member and having a first end fixedly attached to said longitudinal extension member;

said locking mechanism mounted to said stationary member and engaging said elongated connector member;

wherein said longitudinal extension member can be extended beyond said first end of said elongated strut member to increase the length of the frame by forcing said elongated connector member toward said first end, said locking mechanism preventing said longitudinal extension member from being retracted into said elongated strut member.

2. The expandable self-locking frame of claim 1, wherein said elongated connector member has a second end and said longitudinal extension mechanism further includes a longitudinal adjustment member connected to said second end of said elongated connector member, wherein said longitudinal adjustment member may be used to urge said elongated connector member toward said first end of said elongated strut member.

3. The expandable self-locking frame of claim 2, wherein said longitudinal extension mechanism further includes a clamping bracket mounted on said longitudinal extension member and clamping about said elongated strut member to retain said longitudinal extension member within said longitudinal extending channel.

4. The expandable self-locking frame of claim 2, wherein said stationary member is provided with an integral level device which indicates whether said longitudinally extensible strut is oriented in a level manner.

5. The expandable self-locking frame of claim 2, wherein said extension member is provided with an integral level device which indicates whether said longitudinally extensible strut is oriented in a level manner.

6. The expandable self-locking frame of claim 2, wherein said elongated connector member is a threaded push rod and said locking mechanism includes a locking nut disposed about said threaded push rod between said stationary member and said longitudinal extension member.

7. The expandable self-locking frame of claim 2, wherein said longitudinally extending channel of said elongated strut member is defined by inwardly extending flanged edges.

8. The expandable self-locking frame of claim 7, wherein said longitudinal extension member and said longitudinal adjustment member are each provided with guide slots, said inwardly extending flanged edges of said elongated strut member extending into said guide slots such that said longitudinal extension member and said longitudinal adjustment member may be slid along said longitudinally extending channel guided by said inwardly extending flanged edges.

9. The expandable self-locking frame of claim 2, wherein said elongated connector member is a threaded push rod and said locking mechanism includes a detent lever having an aperture provided therethrough, said threaded push rod extending through said aperture with said detent lever biased against said threaded push rod such that said detent lever permits travel of said threaded push rod in an extension direction and opposes travel of said threaded push rod in a retraction direction.

10. The expandable self-locking frame of claim 9, further comprising a spring disposed about said threaded push rod which biases said detent lever against said threaded push rod.

11. The expandable self-locking frame of claim 2, wherein said at least one extensible strut further includes a first lateral extension member extending laterally from said longitudinal extension member and slidably disposed in a longitudinally extending channel of said first elongated track, wherein said first lateral extension member may be slid along said longitudinally extending channel to adjust the width of a first end of said frame.

12. The expandable self-locking frame of claim 11, wherein said first lateral extension member is provided with an outwardly biased retainer and said first elongated track is provided with a plurality of detents spaced longitudinally therein and adapted to receive said outwardly biased retainer, wherein said first lateral extension block can be releasably retained in predetermined lateral positions corresponding to the lateral positions of said detents.

13. The expandable self-locking frame of claim 12, wherein said longitudinally extending channel of said first elongated track is defined by inwardly extending flanged edges which engage guide slots provided in said first lateral extension member.

14. The expandable self-locking frame of claim 11, wherein said at least one extensible strut further includes a second lateral extension member extending laterally from said second end of said elongated strut member and slidably disposed in a longitudinally extending channel of said second elongated track, wherein said second lateral extension member may be slid along said longitudinally extending channel to adjust the width of a second end of said frame.

15. The expandable self-locking frame of claim 14, wherein said second lateral extension member is provided with an outwardly biased retainer and said second elongated track is provided with a plurality of detents spaced longitudinally therein and adapted to receive said outwardly biased retainer, wherein said second lateral extension member can be releasably retained in predetermined lateral positions corresponding to the lateral positions of said detents.

16. The expandable self-locking frame of claim 15, wherein said longitudinally extending channel of said second elongated track is defined by inwardly extending flanged edges which engage guide slots provided in said second lateral extension member.

17. An expandable self-locking wall frame comprising:

an upper elongated track;

a lower elongated track; and at least one vertically extensible stud, said vertically extensible stud having an elongated stud member, a vertical extension mechanism, and a locking mechanism;

said elongated stud member having a vertically extending channel provided therein, and further having an upper end and a lower end, said lower end of said stud member connected to said lower elongated track;

said vertical extension mechanism including a vertical extension block slidably disposed in said vertically extending channel adjacent said upper end of said elongated stud member and contacting said upper elongated track, a vertical adjustment block slidably disposed in said vertically extending channel below said vertical extension block, and a stationary block fixedly disposed in said vertically extending channel between said vertical extension block and said vertical adjustment block, said vertical extension mechanism further including an elongated connector member having an upper end fixedly attached to said vertical extension block and a lower end fixedly attached to said vertical adjustment block;

said locking mechanism mounted to said stationary block and engaging said elongated connector member;

wherein said vertical extension block can be vertically extended along said vertically extending channel beyond said upper end of said elongated stud member with said elongated connector member to increase the height of the wall frame by sliding said vertical adjustment block toward said first end of said vertically extensible stud, said locking mechanism preventing retraction of said vertical extension block into said elongated stud member.

18. The expandable self-locking wall frame of claim 17, wherein said vertical extension mechanism further includes a clamping bracket mounted on said vertical extension block and clamping about said elongated stud member to maintain said vertical extension block within said vertically extending channel.

19. The expandable self-locking wall frame of claim 17, wherein said stationary block is provided with an integral level device which indicates whether said vertically extensible stud is oriented in a level manner.

20. The expandable self-locking wall frame of claim 17, wherein said vertical extension block is provided with an integral level device which indicates whether said vertically extensible stud is oriented in a level manner.

21. The expandable self-locking wall frame of claim 17, wherein said elongated connector member is a threaded push rod and said locking mechanism includes a locking nut disposed about said threaded push rod above said stationary block.

22. The expandable self-locking wall frame of claim 17, wherein said vertically extending channel of said elongated stud member is defined by inwardly extending flanged edges.

23. The expandable self-locking wall frame of claim 22, wherein said vertical extension block and said vertical adjustment block are each provided with guide slots, said inwardly extending flanged edges of said vertically extending channel extending into said guide slots such that said vertical extension block and said vertical adjustment block may be slid along said vertically extending channel guided by said inwardly extending flanged edges.

24. The expandable self-locking wall frame of claim 17, wherein said elongated connector member is a threaded push rod and said locking mechanism includes a detent lever having an aperture provided therethrough, said threaded push rod extending through said aperture with said detent lever biased against said threaded push rod such that said detent lever permits upward travel of said threaded push rod and opposes downward travel of said threaded push rod.

25. The expandable self-locking wall frame of claim 24, further comprising a spring disposed about said threaded push rod which biases said detent lever against said threaded push rod.

26. The expandable self-locking wall frame of claim 17, further including second and third vertically extensible studs having second and third elongated stud members respectively, said second and third vertically extensible studs extending from said upper elongated track to said lower elongated track, and an intermediate track portion extending horizontally between said second and third elongated stud members and provided between said upper and lower elongated tracks such that said second and third elongated stud members, said intermediate track, and a portion of said lower elongated track form a rectangular frame mounting section.

27. The expandable self-locking wall frame of claim 26, further including an intermediate stud member extending from a central portion of said intermediate track portion to said lower elongated track, said intermediate stud member having an integral level device provided therein.

28. The expandable self-locking wall frame of claim 17, wherein said at least one extensible stud further includes an upper horizontal extension block extending laterally from said vertical extension block and slidably disposed in a horizontally extending channel of said upper elongated track, wherein said upper horizontal extension block may be slid laterally along said horizontally extending channel to adjust the width of an upper portion of said wall frame.

29. The expandable self-locking wall frame of claim 28, wherein said upper horizontal extension block is provided with an outwardly biased retainer and said upper elongated track is provided with a plurality of detents spaced horizontally therein and adapted to receive said outwardly biased retainer, wherein said upper horizontal extension block can be releasably retained in predetermined lateral positions corresponding to the lateral positions of said detents.

30. The expandable self-locking wall frame of claim 29, wherein said horizontally extending channel of said upper elongated track is defined by inwardly extending flanged edges which engage guide slots provided in said upper horizontal extension block.

31. The expandable self-locking wall frame of claim 17, wherein said at least one extensible stud further includes a lower horizontal extension block extending laterally from said lower end of said elongated stud member and slidably disposed in a horizontally extending channel of said lower elongated track, wherein said lower horizontal extension block may be slid laterally along said horizontally extending channel to adjust the width of a lower portion of said wall frame.

32. The expandable self-locking wall frame of claim 31, wherein said lower horizontal extension block is provided with an outwardly biased retainer and said lower elongated track is provided with a plurality of detents spaced horizontally therein and adapted to receive said outwardly biased retainer, wherein said lower horizontal extension block can be releasably retained in predetermined lateral positions corresponding to the lateral positions of said detents.

33. The expandable self-locking wall frame of claim 32, wherein said horizontally extending channel of said lower elongated track is defined by inwardly extending flanged edges which engage guide slots provided in said lower horizontal extension block.

34. A longitudinally extensible strut comprising:

an elongated strut member having an longitudinally extending channel provided therein, said elongated strut member further having a first end and a second end;

a longitudinal extension mechanism including a longitudinal extension member slidably disposed in said longitudinally extending channel adjacent said first end of said elongated strut member, a stationary member fixedly disposed in said longitudinally extending channel between said first end and said second end of said elongated strut member, and an elongated connector member extending through said stationary member and having a first end fixedly attached to said longitudinal extension member;

a locking mechanism mounted to said stationary member and engaging said elongated connector member;

wherein said longitudinal extension member can be extended beyond said first end of said elongated strut member to increase the length of the longitudinally extensible strut by forcing said elongated connector member through said stationary member and toward said first end of said elongated strut member, said locking mechanism preventing said longitudinal extension member from being inadvertently retracted into said elongated strut member.

35. The longitudinally extensible strut of claim 34, wherein said elongated connector member has a second end and said longitudinal extension mechanism further includes a longitudinal adjustment member connected to said second end of said elongated connector member, wherein said longitudinal adjustment member may be used to urge said elongated connector member towards said first end of said elongated strut member.

36. The longitudinally extensible strut of claim 35, wherein said longitudinally extending channel of said elongated strut member is defined by inwardly extending flanged edges.

37. The longitudinally extensible strut of claim 36, wherein said longitudinal extension member and said longitudinal adjustment member are each provided with guide slots, said inwardly extending flanged edges of said elongated strut member extending into said guide slots such that said longitudinal extension member and said longitudinal adjustment member may be slid along said longitudinally extending channel guided by said inwardly extending flanged edges.

38. The longitudinally extensible strut of claim 35, wherein said longitudinal extension mechanism further includes a clamping bracket mounted on said longitudinal extension member and clamping about said elongated strut member to retain said longitudinal extension member within said longitudinal extending channel.

39. The longitudinally extensible strut of claim 35, wherein said stationary member is provided with an integral level device which indicates whether said longitudinally extensible strut is oriented in a level manner.

40. The longitudinally extensible strut of claim 35, wherein said extension member is provided with an integral level device which indicates whether said longitudinally extensible strut is oriented in a level manner.

41. The longitudinally extensible strut of claim 35, wherein said elongated connector member is a threaded push rod and said locking mechanism includes a detent lever having an aperture provided therethrough, said threaded push rod extending through said aperture with said detent lever biased against said threaded push rod such that said detent lever permits travel of said threaded push rod in an extension direction and opposes travel of said threaded push rod in a retraction direction.

42. The longitudinally extensible strut of claim 41, further comprising a spring disposed about said threaded push rod which biases said detent lever against said threaded push rod.

43. The longitudinally extensible strut of claim 35, wherein said elongated connector member is a threaded push rod and said locking mechanism includes a locking nut disposed about said threaded push rod between said stationary member and said longitudinal extension member.

44. A longitudinal extension mechanism for use in a longitudinally extensible strut having an elongated strut member provided with a longitudinally extending channel therein and having first and second ends, said longitudinal extension mechanism comprising:

a longitudinal extension member adapted to be slidably disposed in the longitudinally extending channel adjacent the first end of the elongated strut member;

a longitudinal adjustment member adapted to be slidably disposed in the longitudinally extending channel between the first and said second ends of the elongated strut member;

a stationary member adapted to be fixedly disposed in the longitudinally extending channel between said longitudinal extension member and said longitudinal adjustment member;

an elongated connector member having a first end fixedly attached to said longitudinal extension member and a second end fixedly attached to said longitudinal adjustment member; and a locking mechanism mounted to said stationary member and engaging said elongated connector member;

wherein said extension member can be extended beyond the first end of the elongated strut member with said elongated connector member to increase the length of the longitudinally extensible strut by sliding said longitudinal adjustment member along the longitudinally extending channel toward the first end of the elongated strut member, said locking mechanism preventing said extension member from being inadvertently retracted into the elongated strut member.

45. The longitudinal extension mechanism of claim 44, wherein said longitudinal extension member and said longitudinal adjustment member are each provided with guide slots adapted to engage inwardly extending flanged edges of the elongated strut member such that said longitudinal extension member and said longitudinal adjustment member may be slid along the longitudinally extending channel guided by the inwardly extending flanged edges.

46. The longitudinal extension mechanism of claim 44, wherein said longitudinal extension mechanism further includes a clamping bracket mounted on said longitudinal extension member and adapted to clamp about the elongated strut member to retain said longitudinal extension member within the longitudinal extending channel.

47. The longitudinal extension mechanism of claim 44, wherein said stationary member is provided with an integral level device which indicates whether said longitudinal extension mechanism is oriented in a level manner.

48. The longitudinal extension mechanism of claim 44, wherein said extension member is provided with an integral level device which indicates whether said longitudinal extension mechanism is oriented in a level manner.

49. The longitudinal extension mechanism of claim 44, wherein said elongated connector member is a threaded push rod and said locking mechanism includes a detent lever having an aperture provided therethrough, said threaded push rod extending through said aperture with said detent lever biased against said threaded push rod such that said detent lever permits travel of said threaded push rod in an extension direction and opposes travel of said threaded push rod in a retraction direction.

50. The longitudinal extension mechanism of claim 49, further comprising a spring disposed about said threaded push rod which biases said detent lever against said threaded push rod.

51. The longitudinal extension mechanism of claim 44, wherein said elongated connector member is a threaded push rod and said locking mechanism includes a locking nut disposed about said threaded push rod between said stationary member and said longitudinal extension member.

52. A locking mechanism for use in a longitudinally extensible strut having a elongated strut member, said locking mechanism comprising:

a stationary member adapted to be fixedly disposed in a channel of the elongated strut member;

a detent lever having a proximal end, a distal end, and an aperture provided therebetween, said detent lever attached to said stationary member at said proximal end;

an elongated connector member extending through said stationary member and through said aperture provided through said detent lever, said elongated connector member being provided with a plurality of ratchet teeth; and a biasing element disposed about said elongated connector member between said detent lever and said stationary member, said biasing element urging said detent lever against said ratchet such that said elongated connector member may be manually forced through said detent lever aperture in a first direction with said ratchet teeth successively momentarily displacing said detent lever against the force of said biasing element, and further may be retracted through said aperture in a second direction by manually depressing said distal end of said detent lever toward said stationary member and pulling said elongated connector member away from said stationary member.

* * * * *